US006679676B2

(12) United States Patent
Houze

(10) Patent No.: US 6,679,676 B2
(45) Date of Patent: Jan. 20, 2004

(54) TEMPERATURE CONTROL WITH CONSTANT COOLING FLOW AND TEMPERATURE FOR VACUUM GENERATING DEVICE

(75) Inventor: François Houze, Cuvat (FR)

(73) Assignee: Alcatel, Paris (FR)

( * ) Notice: Subject to any disclaimer, the term of this patent is extended or adjusted under 35 U.S.C. 154(b) by 70 days.

(21) Appl. No.: 10/049,132

(22) PCT Filed: Jun. 15, 2001

(86) PCT No.: PCT/FR01/01866

§ 371 (c)(1),
(2), (4) Date: Feb. 8, 2002

(87) PCT Pub. No.: WO01/96744

PCT Pub. Date: Dec. 20, 2001

(65) Prior Publication Data

US 2002/0106285 A1 Aug. 8, 2002

(30) Foreign Application Priority Data

Jun. 15, 2000 (FR) ..... 00 07627

(51) Int. Cl.[7] ..... F04D 29/58
(52) U.S. Cl. ..... 415/47; 415/175; 415/177
(58) Field of Search ..... 415/47, 90, 175, 415/177; 417/423.4

(56) References Cited

U.S. PATENT DOCUMENTS 4,904,155 A * 2/1990 Nagaoka et al. ..... 415/177 X
4,929,151 A * 5/1990 Long et al. ..... 415/177
5,190,438 A 3/1993 Taniyama et al.
5,577,883 A * 11/1996 Schutz et al. ..... 415/177 X

FOREIGN PATENT DOCUMENTS

JP 01008388 1/1989

OTHER PUBLICATIONS

Patent Abstracts of Japan, vol. 1995, No. 10, Nov. 30, 1995 corresponding to JP 07 174099 A (Hitachi Ltd.) dated Jul. 11, 1995.

Patent Abstracts of Japan, vol. 011, No. 081,(E–488), Mar. 12, 1987 corresponding to JP 61 236123 A (Hitachi Ltd) dated Oct. 21, 1986.

Patent Abstracts of Japan, vol. 016, No. 458, Sep. 24, 1992 corresponding to JP 04 164188 A (Hitachi Ltd) dated Jun. 9, 1992.

Patent Abstracts of Japan, vol. 2000, No. 01, Jan. 31, 2000 corresponding to JP 11 280681 A (Taiko Kikai Industries Co Ltd) dated Oct. 15, 1999.

Patent Abstracts of Japan, vol. 017, No. 486 (M–1473) Sep. 3, 1993 corresponding to JP 05 118296 A (Hitachi Ltd) dated May 14, 1993.

* cited by examiner

*Primary Examiner*—Edward K. Look
*Assistant Examiner*—Richard Edgar
(74) *Attorney, Agent, or Firm*—Sughrue Mion, PLLC

(57) ABSTRACT

The invention concerns a vacuum generating device wherein the vacuum pump body (1) comprises cavities forming regulating chambers (12), closed at their ends by closure means such as sealing plugs (26, 27), and run through by an exchange pipe (14) wherein flows a liquid coolant coming from a heat source. The regulating chamber (12) is connected by a pipe wherein thermal conduction liquid (16) flows to a reserve of thermal conduction liquid (17) which through a piston (18) stressed by an actuator (19), adjusts the upper level (22) of a thermal conduction liquid (15) in the regulating chamber (12), thereby modifying the thermal conductance between the pump body (1) and the liquid coolant flowing in the exchange pipe (14). Thus the risk of scale deposit is reduced in the exchange pipe (14) of a vacuum pump (1), while controlling the temperature of the pump body (1).

11 Claims, 4 Drawing Sheets

TEMPERATURE CONTROL WITH CONSTANT COOLING FLOW AND TEMPERATURE FOR VACUUM GENERATING DEVICE

TECHNICAL FIELD OF THE INVENTION

The present invention relates to vacuum generator devices.

One of the common uses of vacuum generator devices is to generate a vacuum in an enclosure for processing semiconductors.

During such processing, material is deposited on or etching is performed in a semiconductor wafer. The efficiency of deposition is relatively low, and as a result the vacuum generator device sucks in a large fraction of the materials that are to be deposited on the semiconductor wafer. The vacuum generator device also sucks in the materials which are extracted from the semiconductor wafer during etching operations.

Vacuum generator devices comprise at least a primary pump which delivers pumped gas to atmospheric pressure or to a pressure that is relatively high. In such a primary pump, the pumped gases tend to condense and solidify in the form of deposits when their temperature is too low, or when temperature variations are too large. Those deposits interfere with the operation of the pump and the quality of the vacuum generated, and can give rise to pollution by being scattered back into the enclosure for processing semiconductors.

It is desired to limit the deposition of solids that results from condensation or solidification of gases by regulating the temperature of the pump body in a manner that is as stable as possible.

In known systems, the pump body is temperature regulated by a system for controlling the temperature of the vacuum pump and comprising at least one heat exchange circuit in which a heat-conveying liquid circulates, at least a first portion of the circuit being in thermal communication with the vacuum pump and a second portion of the circuit being in connection with a source of heat. Means are provided for causing the heat-conveying liquid to circulate in the heat exchange circuit.

In a first possibility, e.g. as described in document JP 11 280681, control means enable the flow rate of the heat-conveying liquid in the heat exchange circuit to be varied, thereby modulating the heat exchange capacity of the heat exchange circuit as a function of a control signal so as to match it to the heat exchange requirement for keeping the temperature of the pump in a suitable temperature range.

The amount of heat that needs to be exchanged to regulate the temperature of the pump leads to the flow rate of the heat-conveying liquid being varied very greatly. Thus, the speed of the heat-conveying liquid is variable, being low during certain operating stages, and its temperature is also variable and is high during certain operating stages.

In another possibility, control means serve to vary the power of the heat source, e.g. by adjusting the electrical current used for heating, as described in document JP 01 008388, or by adjusting the speed of a cooling fan, as described in document JP 07 174099. In all cases, the temperature of the heat-conveying liquid is highly variable as a function of the heat power to be conveyed.

A problem encountered in those known systems for controlling temperature is the deposition of scale in the pipework and in the parts to be cooled when ordinary public water supply water is used as the heat-conveying liquid. The lime naturally present in suspension in the water solidifies and forms deposits of scale in the pipework and in the parts to be cooled, initially spoiling heat exchange quality, and capable in the end of blocking said pipework or parts.

SUMMARY OF THE INVENTION

The problem proposed by the present invention is that of designing a novel structure for a temperature control system in vacuum generator devices to make it possible to ensure effective temperature regulation while avoiding the above-mentioned deposition of scale.

The idea on which the present invention is based consists in causing a heat-conveying liquid to flow in the heat exchange circuit continuously at a relatively high speed and at a relatively low temperature, regardless of the operating stages of the vacuum generator device, while providing means other than speed variation for regulating the temperature of the pumps.

The proposed principle is based on providing adjustable thermal conductance between the heat-conveying liquid and the vacuum pump. This makes it possible to keep the heat-conveying liquid circulating continuously at maximum flow rate and at low temperature, the flow rate being not less than the flow rate required for guaranteeing sufficient heat exchange under the extreme operating conditions of the vacuum pump.

To achieve these objects, and others, a vacuum generator device of the invention comprises at least a vacuum pump and a system for controlling the temperature of the vacuum pump, the temperature control system having at least one heat exchange circuit in which a heat-conveying liquid circulates and including at least one first circuit portion which is in thermal communication with the pump body of the vacuum pump, including circulation means for causing the heat-conveying liquid to circulate in the heat exchange circuit, and having control means for controlling the heat exchange capacity of the heat exchange circuit as a function of a control signal;

according to the invention:

- heat conduction means having thermal conductance that is adjustable by the control means provide thermal communication between the pump body and the first circuit portion;
- the control means are adapted to vary the thermal conductance of the heat conduction means so as to maintain the temperature of the pump body in the vicinity of a predetermined reference temperature;
- the circulation means, for causing the heat-conveying liquid to circulate, are adapted to cause the heat-conveying liquid to circulate permanently in the heat exchange circuit at a flow rate that is not less than the flow rate required for providing sufficient heat exchange under extreme operating conditions of the vacuum pump.

In a first application, the heat exchange circuit is adapted to heat the vacuum pump. In which case, the device is used in those zones of the vacuum generator device where it is necessary to heat the vacuum line in order to avoid solids being deposited.

In a second application, the heat exchange circuit is adapted to cool the vacuum pump. The device is then used in those zones of the vacuum generator device in which pumping gives rise to excessive heating.

A combination of both applications can be provided, making it possible either to heat or to cool a given same zone of the vacuum generator device.

In an advantageous embodiment, the heat conduction means having adjustable thermal conductance comprise:

at least one adjustment chamber interposed between the first circuit portion and the pump body;

a source of thermal communication liquid, connected to the adjustment chamber, and adapted to feed the adjustment chamber with an adjustable quantity of a thermal communication liquid so as to adjust the heat exchange area occupied by the thermal communication liquid between the first circuit portion and the pump body.

In this case, the source of thermal communication liquid comprises a pipe for passing the thermal communication liquid, a supply of thermal communication liquid, and liquid adjustment means to cause the thermal communication liquid to pass between the adjustment chamber and the supply of thermal communication liquid.

The liquid adjustment means may comprise a piston disposed in the supply of thermal communication liquid and driven by an actuator controlled by a control member as a function of a temperature order signal and of pump temperature measurement signals coming from temperature sensors associated with the pump body.

In a practical embodiment, the adjustment chamber can be a cavity formed in the pump body with a heat exchange pipe passing therethrough, said pipe forming said first circuit portion, the cavity being closed by closure means making it leaktight relative to the atmosphere, the heat exchange pipe having at least one portion rising between two distinct extreme levels defining the extreme depth to which the thermal communication liquid can be adjusted.

Preferably, in order to make implementation easier, the adjustment chamber has two opposite ends and has the heat exchange pipe passing therethrough between a bottom orifice and a top orifice.

The adjustment chamber may be closed at its end(s) by one or more leaktight plugs, or by crimping around the heat exchange pipe.

BRIEF DESCRIPTION OF THE DRAWINGS

Other objects, characteristics, and advantages of the present invention appear from the following description of particular embodiments, given with reference to the accompanying figures, in which.

DESCRIPTION OF PREFERRED EMBODIMENTS

Figure 1:
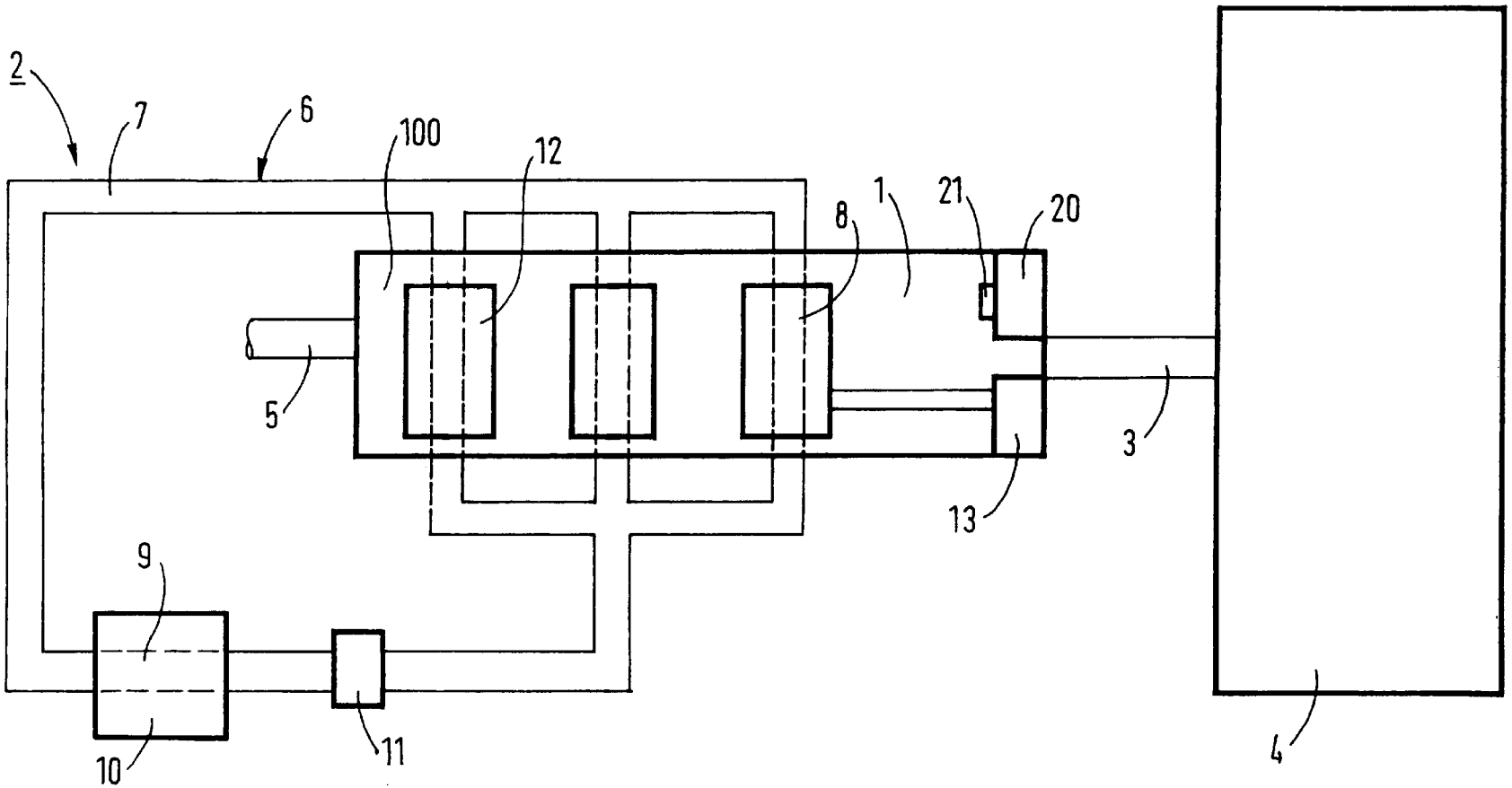
FIG. 1 is a block diagram showing a vacuum generator device constituting an embodiment of the present invention.

In the embodiment shown in FIG. 1, a vacuum generator device of the invention comprises at least one vacuum pump 100 and a temperature control system 2 for controlling the temperature of the vacuum pump 100. The vacuum pump 100 comprises a pump body 1 having a suction inlet 3 connected directly or indirectly to a vacuum enclosure 4, e.g. a process enclosure for processing semiconductor wafers. The vacuum pump 100 delivers through an outlet 5 to a higher pressure, e.g. to atmospheric pressure.

The temperature control system 2 comprises a heat exchange circuit 6 circulating a heat-conveying liquid such as water, oil, or glycol, for example. In the embodiment shown in FIG. 1, the heat exchange circuit 6 comprises an external pipe 7 connected to at least a first portion 8 of the circuit and to at least a second portion 9 of the circuit. The first circuit portion 8 is in thermal communication with the pump body 1 of the vacuum pump 100. The second circuit portion 9 is in thermal communication with a heat source 10. Circulation-driving means such as a circulation pump 11 are provided to cause the heat-conveying liquid to circulate in the heat exchange circuit 6. Control means enable the heat exchange capacity of the heat exchange circuit 6 to be controlled as a function of a control signal.

In the invention, the heat exchange capacity of the heat exchange circuit 6 is varied by interposing heat conduction means of adjustable thermal conductance in the interface between the first circuit portion 8 and the pump body 1 of the vacuum pump 100.

By way of example, it is possible to provide a plurality of first circuit portions 8, with heat conduction means of adjustable thermal conductance putting the pump body 1 into thermal communication with each first circuit portion such as the first portion 8.

Figure 2:
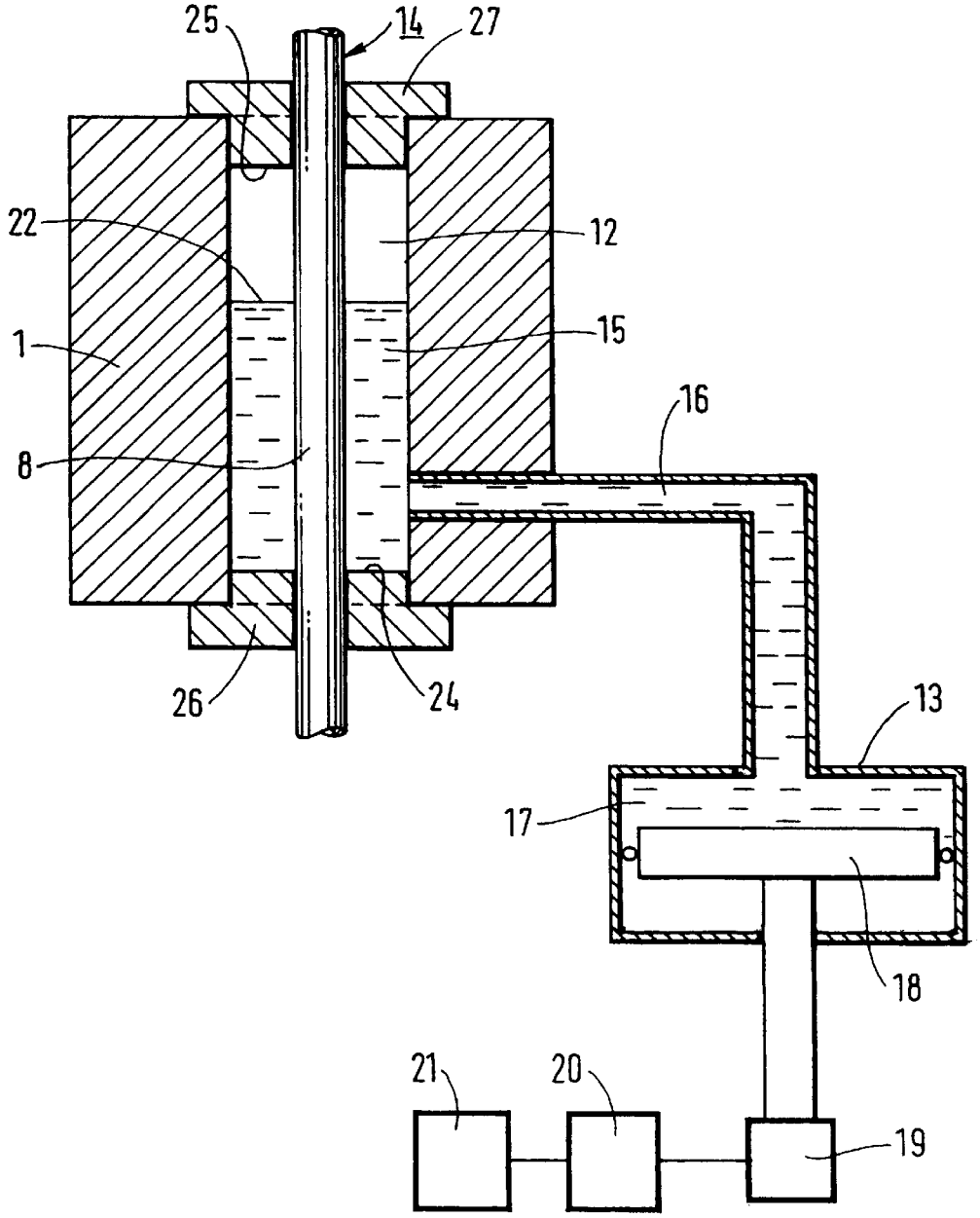
FIG. 2 is a diagram showing a detail of the heat conduction means having adjustable thermal conductance in an embodiment of the present invention.

With reference more particularly to FIGS. 1 and 2, in this embodiment the heat conduction means having adjustable thermal conductance comprise at least one adjustment chamber 12 interposed between the first circuit portion 8 and the pump body 1. A thermal communication liquid source 13 is connected to the adjustment chamber 12 and is adapted to feed the adjustment chamber 12 with an adjustable quantity of a thermal communication liquid 15 such as water, oil, or glycol, for example.

In the adjustment chamber 12, the first circuit portion 8, e.g. in the form of a rectilinear tubular heat exchange pipe 14 is in contact with the thermal communication liquid 15 over a fraction of its side surface, the thermal communication liquid 15 itself being in contact with a fraction of the peripheral surface of the adjustment chamber 12 constituted by the pump body 1. The thermal communication liquid thus provides thermal communication between the pump body 1 and the heat-conveying liquid contained inside the heat exchange pipe 14 of the heat exchange circuit 6.

The thermal communication liquid source 13 is adapted to feed the adjustment chamber 12 with an adjustable quantity of thermal communication liquid 15 so as to adjust the heat exchange area occupied by the thermal communication liquid 15 between the first circuit portion 8 and the pump body 1.

In the embodiment shown in FIG. 2, the thermal communication liquid source 13 comprises a pipe 16 for passing thermal communication liquid, a supply 17 of thermal communication liquid, liquid adjustment means to cause the thermal communication liquid 15 to pass in both directions between the adjustment chamber 12 and the supply 17 of thermal communication liquid.

The liquid adjustment means comprise a piston 18 placed in the supply 17 of thermal communication liquid and driven by an actuator 19 controlled by a control member 20 (FIGS. 1 and 2).

By way of example, the control member is an electrical circuit for controlling the actuator 19 as a function of a temperature reference signal and as a function of measured temperature signals from the pump delivered by temperature sensors 21 associated with the pump body 1.

Thus, in operation, on receiving control signals, the actuator 19 moves the piston 18 so as to modify the quantity of thermal communication liquid 15 that is contained in the adjustment chamber 12, thereby varying the level 22 of the thermal communication liquid 15 and thus varying the heat exchange area occupied by the thermal communication liquid 15 between the pump body 1 and the heat exchange pipe 14 of the first circuit portion 8 in which the heat-conveying liquid circulates. The control member 20, the actuator 19, the piston 18, the supply 17 of thermal communication liquid, the pipe 16 passing the thermal communication liquid, the adjustment chamber 12, and the thermal communication liquid 15 thus constitute control means which are adapted to vary the thermal conductance of the heat conduction means between the pump body 1 and the first circuit portion 8 in such a manner as to keep the temperature of the pump body 1 in the vicinity of a predetermined reference temperature.

This makes it possible advantageously to select circulation driving means such as the circulation pump 11 which are adapted to cause the heat-conveying liquid to circulate permanently in the heat exchange circuit 6 at a permanent flow rate not less than the flow rate required for providing sufficient heat exchange under extreme operating conditions of the vacuum pump 100. Under such extreme operating conditions, the vacuum pump 100 has maximum heat exchange requirements, and this maximum heat exchange is provided at the permanent flow rate selected for the heat-conveying liquid when the adjustment chamber 12 is full of thermal communication liquid 15. It should be observed that the permanent flow rate is advantageously a constant flow rate.

Figure 3:
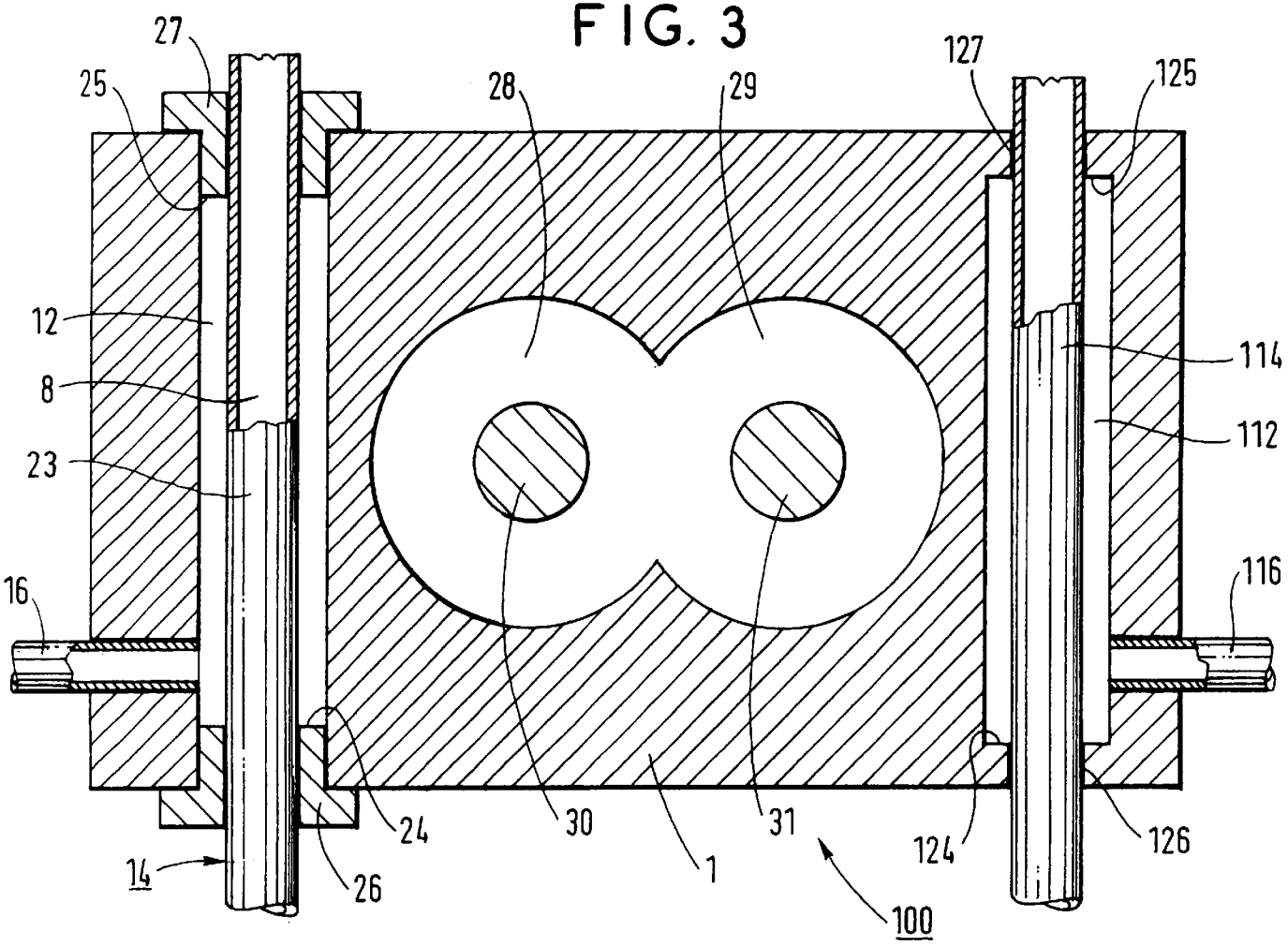
FIG. 3 is a diagrammatic section view of a vacuum pump body with a cooling system implementing two embodiments of the present invention.

FIG. 3 shows two embodiments of the adjustment chamber 12 in a pump body 1.

In both embodiments, the adjustment chamber 12 is a cavity formed directly in the pump body 1, and it has a heat exchange pipe 14 passing therethrough, with the outside section of the pipe being smaller than the inside section of the adjustment chamber 12. Thus, the cavity constituting the adjustment chamber 12 has the heat exchange pipe 14 forming said first circuit portion 8 passing therethrough and enabling the heat-conveying liquid to circulate. The adjustment chamber 12 is closed by closure means which make it leaktight relative to the outside atmosphere while still allowing the heat exchange pipe 14 to pass through. In order to enable the thermal conductance to be adjusted effectively by modifying the depth of thermal communication liquid, the heat exchange pipe 14 comprises inside the adjustment chamber 12 at least one rising portion 23 between two extreme levels 24 and 25 that are different and that define the extreme levels for adjusting the level 22 of the thermal communication liquid inside the adjustment chamber 12.

For example, the adjustment chamber 12 can be open at two opposite ends, i.e. a bottom end 24 and a top end 25, with the heat exchange pipe 14 passing therethrough.

In the embodiment shown on the left-hand side of FIG. 3, each of the bottom 24 and top ends 25 is closed by a respective leaktight plug 26 or 27. The pipe 16 for passing the thermal communication liquid communicates with the adjustment chamber 12 close to its bottom end 24.

In the embodiment shown on the right-hand side of FIG. 3, the adjustment chamber 112 communicates with the pipe 116 for passing the thermal communication liquid in the vicinity of its bottom end 124, and it is closed at its bottom end 124 and at its top end 125 via respective regions of crimping 126 and 127 around the heat exchange pipe 114.

In the embodiment shown in FIG. 3, the vacuum pump 100 includes inside its pump body 1, e.g. made of cast iron, two pump chambers 28 and 29 each receiving a rotor driven by a shaft such as the shafts 30 and 31.

In the pump body 1, the adjustment chambers 12 and 112 can extend in a direction that is substantially vertical, for example.

In this same embodiment, the walls of the adjustment chambers 12 and 112 are smooth, as is the outside face of the heat exchange pipes 14 or 114.

Figure 4:
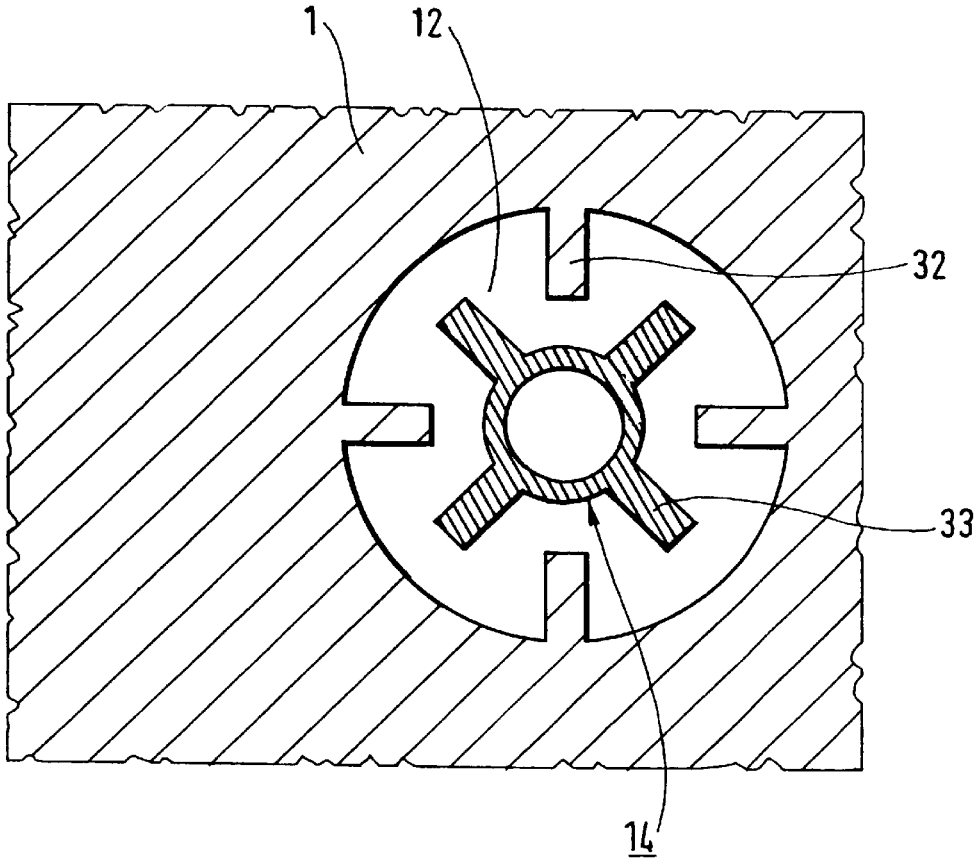
FIG. 4 is a cross-section through an adjustment chamber in a particular embodiment of the invention.

In the embodiment shown in cross-section in FIG. 4, heat exchange area is increased by the peripheral wall of the adjustment chamber 12 constituted by the pump body 1 having radial fins such as the fin 32. Similarly, the outside surface of the heat exchange pipe 14 has radial fins such as the fin 33.

The structure of the temperature control system 2 of the invention makes it possible to maximize the circulation speed of the heat-conveying liquid while simultaneously minimizing its temperature, thus minimizing the risks of deposits appearing in the heat exchange circuit 6. Simultaneously, the heat conduction means having adjustable thermal conductance make it possible to regulate the temperature of the vacuum pump 1 in effective manner by using means that are inexpensive and efficient. It should be observed that the actuator 19, the supply 17 of thermal communication liquid, and the piston 18 therein, together with the control member 20 can all be located at a distance from the adjustment chambers 12 or 112, and can thus be positioned in any suitable location, for example in empty zones around the pump body 1, thus making it possible to reduce the overall volume of the vacuum generator device.

The end zones 124 and 125 of the adjustment chamber 112 can be crimped by expanding the heat exchange pipe 114 radially in the housing constituting the adjustment chamber 112.

The present invention is not limited to the embodiments particularly described herein, but it includes the generalizations and variants that are accessible to the person skilled in the art.

What is claimed is:

1. A vacuum generator device comprising at least one vacuum pump and a temperature control system which controls the temperature of the vacuum pump, the temperature control system having at least one heat exchange circuit in which a heat-conveying liquid circulates and including at least one first circuit portion which is in thermal communication with the pump body of the vacuum pump, including circulation means which causes the heat-conveying liquid to circulate in the heat exchange circuit, and having control means which controls the heat exchange capacity of the heat exchange circuit as a function of a control signal, wherein heat conduction means having thermal conductance that is adjustable by the control means provide thermal communication between the pump body and the first circuit portion;

the control means vary the thermal conductance of the heat conduction means so as to maintain the temperature of the pump body in the vicinity of a predetermined reference temperature;

the circulation means cause the heat-conveying liquid to circulate permanently in the heat exchange circuit at a flow rate that is not less than the flow rate required for providing sufficient heat exchange under extreme operating conditions of the vacuum pump.

2. A device according to claim 1, wherein the heat exchange circuit is adapted to heat the vacuum pump.

3. A device according to claim 1, wherein the heat exchange circuit is adapted to cool the vacuum pump.

4. A vacuum generator device comprising at least one vacuum pump and a temperature control system which controls the temperature of the vacuum pump, the temperature control system having at least one heat exchange circuit in which a heat-conveying liquid circulates and including at least one first circuit portion which is in thermal communication with the pump body of the vacuum pump, including circulation means which causes the heat-conveying liquid to circulate in the heat exchange circuit, and having control means which controls the heat exchange capacity of the heat exchange circuit as a function of a control signal, wherein heat conduction means having thermal conductance that is adjustable by the control means provide adjustable thermal communication between the pump body and the first circuit portion;

the control means vary the thermal conductance of the heat conduction means so as to maintain the temperature of the pump body in the vicinity of a predetermined reference temperature;

the circulation means cause the heat-conveying liquid to circulate permanently in the heat exchange circuit at a flow rate that is not less than the flow rate required for providing sufficient heat exchange under extreme operating conditions of the vacuum pump.

5. A vacuum generator device comprising at least one vacuum pump and a temperature control system which controls the temperature of the vacuum pump, the temperature control system having at least one heat exchange circuit in which a heat-conveying liquid circulates and including at least one first circuit portion which is in thermal communication with the pump body of the vacuum pump including circulation means which causes the heat-conveying liciuid to circulate in the heat exchange circuit, and having control means which controls the heat exchange capacity of the heat exchange circuit as a function of a control signal, wherein heat conduction means having thermal coductance that is adjustable by the control means provide thermal communication between he pump body and the first circuit portion;

the control means vary the thermal conductance of the heat conduction means so as to maintain the temperature of the pump body in the vicinity of a predetermined reference temperature;

the circulation means cause the heat-conveying liquid to circulate permanently in the heat exchange circuit at a flow rate that is not less than the flow rate required for providing sufficient heat exchange under extreme operating conditions of the vacuum pump, wherein the heat conduction means comprise:

at least one adjustment chamber interposed between the first circuit portion and the pump body;

a source of thermal communication liquid, connected to the adjustment chamber, and feeding the adjustment chamber with an adjustable quantity of a thermal communication liquid so as to adjust the heat exchange area occupied by the thermal communication liquid between the first circuit portion and the pump body.

6. A device according to claim 5, wherein the source of thermal communication liquid comprises a pipe for passing the thermal communication liquid, a supply of thermal communication liquid, and liquid adjustment means which cause the thermal communication liquid to pass between the adjustment chamber and the supply of thermal communication liquid.

7. A device according to claim 6, wherein the liquid adjustment means comprise a piston disposed in the supply of thermal communication liquid and driven by an actuator controlled by a control member as function of a temperature order signal and of pump temperature measurement signals coming from temperature sensors associated with the pump body.

8. A device according to claim 5, wherein the adjustment chamber is a cavity formed in the pump body with a heat exchange pipe passing therethrough, said pipe forming said first circuit portion, the cavity being closed by closure means making it leaktight relative to the atmosphere, the heat exchange pipe having at least one portion rising between two distinct extreme levels defining the extreme depth to which the thermal communication liquid can be adjusted.

9. A device according to claim 8, wherein the adjustment chamber has two opposite ends and has the heat exchange pipe passing therethrough.

10. A device according to claim 8, wherein the adjustment chamber is closed at its end(s) by one or more leaktight plugs.

11. A device according to claim 8, wherein the adjustment chamber is closed by crimping around the heat exchange pipe.

* * * * *